US007435131B1

(12) United States Patent
Lee

(10) Patent No.: US 7,435,131 B1
(45) Date of Patent: Oct. 14, 2008

(54) ELECTRICAL CONNECTOR

(75) Inventor: Wen-Lung Lee, Chung Ho (TW)

(73) Assignee: Jess-Link Products Co., Ltd., Taipei County (TW)

( * ) Notice: Subject to any disclaimer, the term of this patent is extended or adjusted under 35 U.S.C. 154(b) by 0 days.

(21) Appl. No.: 12/000,110

(22) Filed: Dec. 10, 2007

(51) Int. Cl.
*H01R 12/24* (2006.01)

(52) U.S. Cl. ..... 439/495; 439/354

(58) Field of Classification Search ..... 439/354, 439/357, 492–499, 607, 610
See application file for complete search history.

(56) References Cited

U.S. PATENT DOCUMENTS 4,008,941 A * 2/1977 Smith ..... 439/358
4,188,086 A * 2/1980 Inouye et al. ..... 439/496
4,629,271 A * 12/1986 Awano ..... 439/260
5,921,808 A * 7/1999 Haftmann et al. ..... 439/495
6,179,642 B1 * 1/2001 Hwang ..... 439/358
6,482,027 B2 * 11/2002 Ishii et al. ..... 439/495
6,773,288 B2 * 8/2004 Geltsch et al. ..... 439/329

* cited by examiner

*Primary Examiner*—Khiem Nguyen
(74) *Attorney, Agent, or Firm*—Rosenberg, Klein & Lee

(57) ABSTRACT

An electrical connector includes an insulating main body, a metal shell and a flexible bus line. The insulating main body includes a base portion and two side portions. The front edge of the base portion has a jointing portion, and the jointing portion has slots. The flexible bus line is clipped between the insulating main body and the metal shell. At the middle of the flexible bus line, there are a plurality of naked metal conducting lines. The metal conducting lines are located in the corresponding slots of the jointing portion, and each of two ends of each metal conducting line forms a contacting portion. The flexible bus line is bent backwards so that the contacting portions are respectively located at the opposite sides of the jointing portion. Thereby, the naked metal conducting line of the flexible bus line is used as a medium to electrically connect a jointed connector.

10 Claims, 12 Drawing Sheets

ELECTRICAL CONNECTOR

BACKGROUND OF THE INVENTION

1. Field of the Invention

The present invention relates to an electrical connector. In particular, this invention relates to an electrical connector that combines with a flexible bus line and utilizes a metal conducting line of the flexible bus line to electrically connect a jointed connector.

2. Description of the Related Art

The electrical connector of the related art includes an insulating main body, a plurality of pins, and a plurality of cables. The pins are plugged into the insulating main body at internals. The cables are welded to the ends of the pins. The electrical connector is connected with a jointed connector. By contacting the pins of the electrical connector with the pins of the jointed connector, electrical connection is achieved and signals are transmitted via the cables.

However, the electrical connector of the related art has the following problems.

1. The pins must be assembled in the pin-slots of the insulating main body one by one and respectively are welded to the corresponding cables. The quantity of the components for the electrical connector is large, and the assembling process is complex.

2. A punching mold needs to be developed for manufacturing the pins. The manufacturing cost is high.

3. It is difficult to weld the cables to the pins. It is time-consuming, and the yield rate reduces.

SUMMARY OF THE INVENTION

One particular aspect of the present invention is to provide an electrical connector. The insulating main body of the electrical connector is combined with a flexible bus line. The naked metal conducting line of the flexible bus line is used as a medium to electrically connect a jointed connector.

The electrical connector includes an insulating main body having a base portion and two side portions, a metal shell covered on the insulating main body, and a flexible bus line clipped between the insulating main body and the metal shell. The two side portions are located at the two opposite sides of the base portion. The front edge of the base portion has a jointing portion, and the jointing portion has a plurality of slots. At the middle of the flexible bus line, there are a plurality of naked metal conducting lines. The metal conducting lines are located in the corresponding slots of the jointing portion, and each of two ends of each of the metal conducting lines forms a contacting portion. The flexible bus line is bent backwards so that two contacting portions are respectively located at the two opposite sides of the jointing portion.

The present invention has the following characteristics. The present invention uses the metal conducting line of the flexible bus line to replace the pins of the electrical connector of the related art. The cost for manufacturing the pins is reduced, and the welding procedure is not required again. Furthermore, it is easy for the worker to process the flexible bus line, and it is convenient for the worker to assemble the flexible bus line with the insulating main body. The manufacturing time is reduced, and the yield rate is increased.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
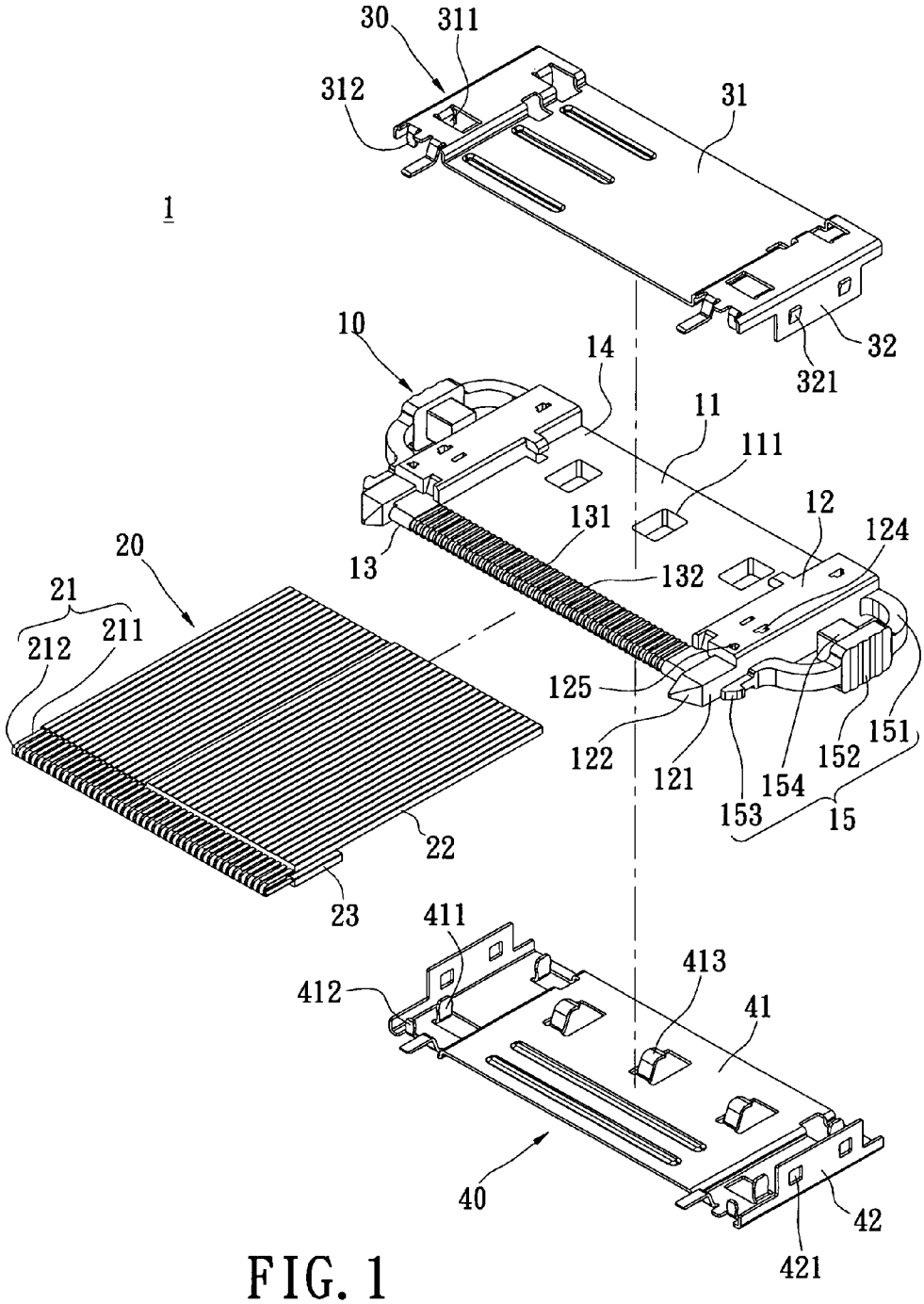
FIG. 1 is an exploded perspective view of the present invention.
Figure 2:
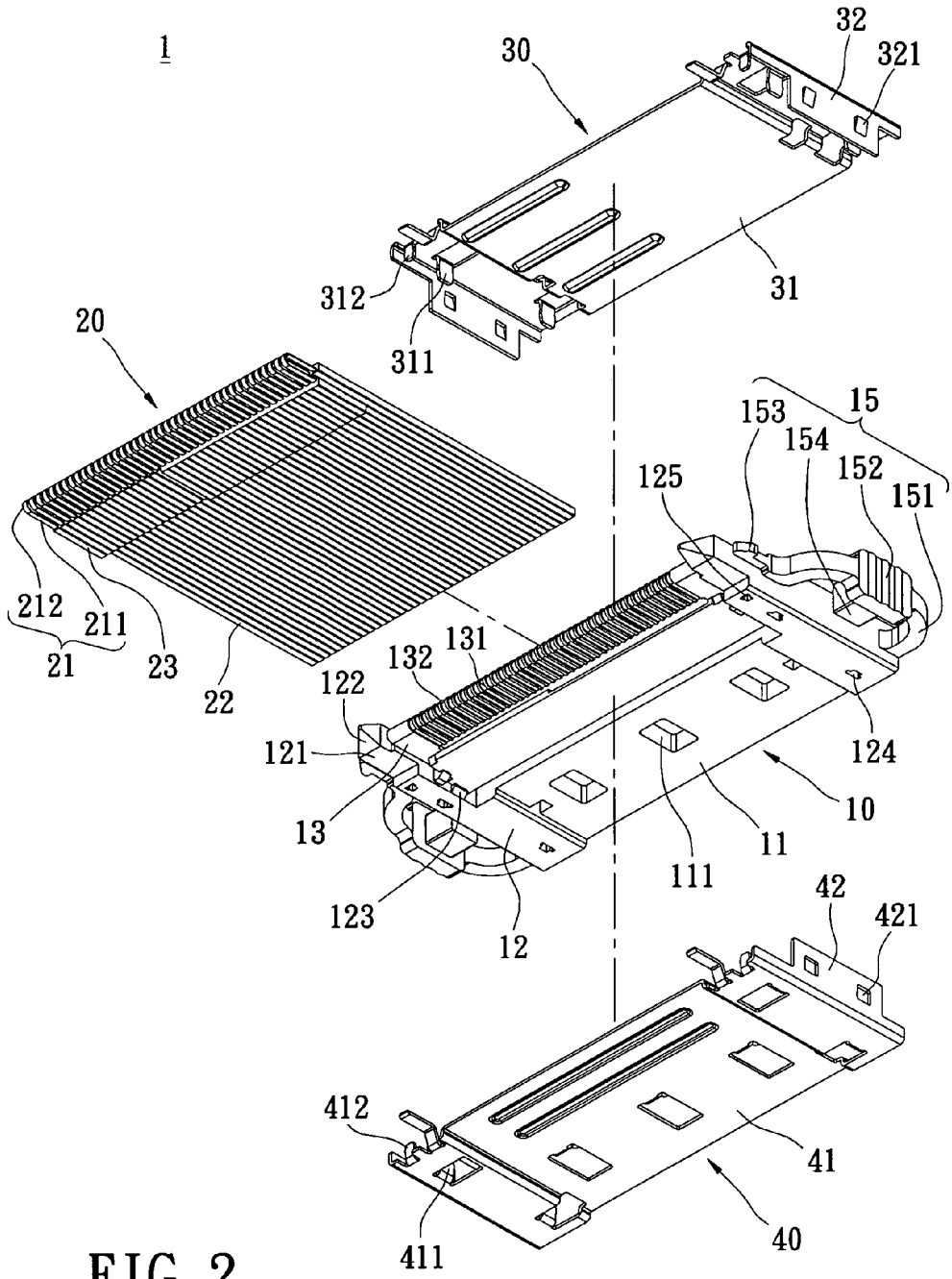
FIG. 2 is another exploded perspective view of the present invention.
Figure 3:
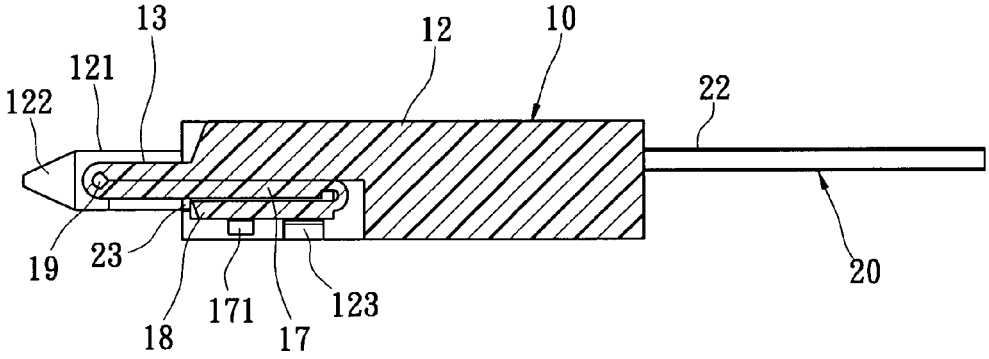
FIG. 3 is a cross-sectional view of the insulating main body combined with the flexible bus line of the present invention.

Reference is made to FIGS. 1~4. The electrical connector 1 includes an insulating main body 10, a flexible bus line 20, a first metal shell 30, and a second metal shell 40.

The insulating main body 10 is made of insulating plastic material. The insulating main body 10 has a base portion 11 and two side portions 12 located at the left side and the right side of the base portion 11. The front edge of the base portion 11 is bent and stacked to form a jointing portion 13 (referring to FIG. 3). The jointing portion 13 is located between the two side portions 12, and has a plurality of slots 131. The slots 131 extends from the top surface of the jointing portion 13, passes the front edge of the jointing portion 13 and extends to the bottom surface of the jointing portion 13. There are a plurality of separating boards 132 are formed between the slots 131. At the rear end of the base portion 11, there are a plurality of through holes 111.

The top surface of the base portion 11 and the two side portions 12 form a receiving space 12 for receiving the flexible bus line 20, and the receiving space 14 links with the through holes 111.

The front ends of the two side portions 12 respectively protrude forwards to form a guiding portion 121. The front end of each of the two guiding portions 121 has a guiding slanted surface 122. The inner side of each of the two side portions 12 that is close to the bottom of the side portion 12 protrudes to form a wedging body 123 (referring to FIG. 2). Each side portion 12 has two first fastening holes 124 and a second fastening hole 125. The first fastening holes 124 and the second fastening hole 125 passes through the side portion 12 from the top surface to the bottom surface.

Each of the side portions 12 extends outwards to form a wedging part 15. The wedging part 15 has an extending portion 151, a pressing portion 152, and a locking portion 153. The rear end of the extending portion 151 is connected with the outside of the side portion 12. The front end of the extending portion 151 extends forwards to form the pressing portion 152. One end of the pressing portion 152 extends forwards to form the locking portion 153. The pressing portion 152 extends towards to the side portion 12 to form a pushing portion 154. When the wedging part 15 is moved with a proper distance, the pushing portion 154 stops the side portion 12 to prevent the wedging part 15 from being excessively deformed.

The flexible bus line 20 includes a plurality of areas that their thicknesses are different. The insulating external surface of the middle of the flexible bus line 20 is removed and a plurality of metal conducting lines 21 are exposed so that the flexible bus line 20 forms a first area 22 and a second area 23.

The metal conducting lines 21 are made of conductive material. In this embodiment, the metal conducting lines 21 are tin-plated lines. Each of two ends of each metal conducting line 21 forms a contacting portion 211. The middle of the metal conducting line 21 is bent backwards to form a turning portion 212. The turning portion 212 is connected between the two contacting portions 211. The flexible bus line 20 is bent backwards so that two contacting portions 211 are respectively located at the upper side and the lower side of the jointing portion 13 of the insulating main body 10. The turning portion 212 is located at the front edge of the jointing portion 13. The metal conducting lines 21 are located in the corresponding slots 131 of the jointing portion 13.

The first area 22 and the second area 23 are respectively connected with the two ends of the metal conducting lines 21. The flexible bus line 20 is bent backwards so that the first area 22 is parallel to the second area 23. The first area 22 extends backwards to the outside of the rear end of the insulating main body 10. The first area 22 and the second area 23 are respectively located at the upper side and the lower side of the base portion 11 of the insulating main body 10.

Furthermore, the outside of the first area 22 of the flexible bus line 20 further can be wrapped with a sheltering layer (not shown in the figure) that is made of metal material, such as an aluminum foil, or a copper foil etc, to prevent the EMI.

The first metal shell 30 is manufactured by a punching method. The first metal shell 30 includes a top board 31 and two sides boards 32 bent downwards from two sides of the top board 31. The top board 31 extends downwards to form two first fastening portions 311 and a second fastening portion 312. The side board 32 has a plurality of inversed-thorns that extends to outside of the side board 32. The first fastening portions 311 and the second fastening portion 312 are respectively plugged and fastened into the first fastening hole 124 and the second fastening hole 125 from the top of the insulating main body 10 so that the first metal shell 30 covers on the insulating main body 10 and the first area 22 of the flexible bus line 20 is clipped between the base portion 11 of the insulating main body 10 and the first metal shell 30.

The second metal shell 40 is manufactured by a punching method. The second metal shell 40 includes a bottom board 41 and two sides boards 42 bent upwards from two sides of the bottom board 41. The bottom board 41 extends downwards to form two first fastening portions 411 and a second fastening portion 412. The rear end of the bottom board 41 is bent upwards and extended to form a plurality of flexible flakes 413.

The side board 42 has a plurality of wedging holes 421 that correspond to the inversed-thorns 321 of the first metal shell 30. The first fastening portions 411 and the second fastening portion 412 are plugged upwards and fastened in the first fastening hole 124 and the second fastening hole 125 from the bottom of the insulating main body 10. The inversed-thorns 321 are wedged with the wedging holes 421. Thereby, the second metal shell 40 is installed at the bottom of the insulating main body 10 and is connected with the first metal shell 30. The flexible flakes 413 pass through the through holes 111 of the insulating main body 10 and contact the bottom surface of the first area 22 of the flexible bus line 20 (referring to FIG. 5) so that the flexible bus line 20 is firmly fastened.

Figure 4:
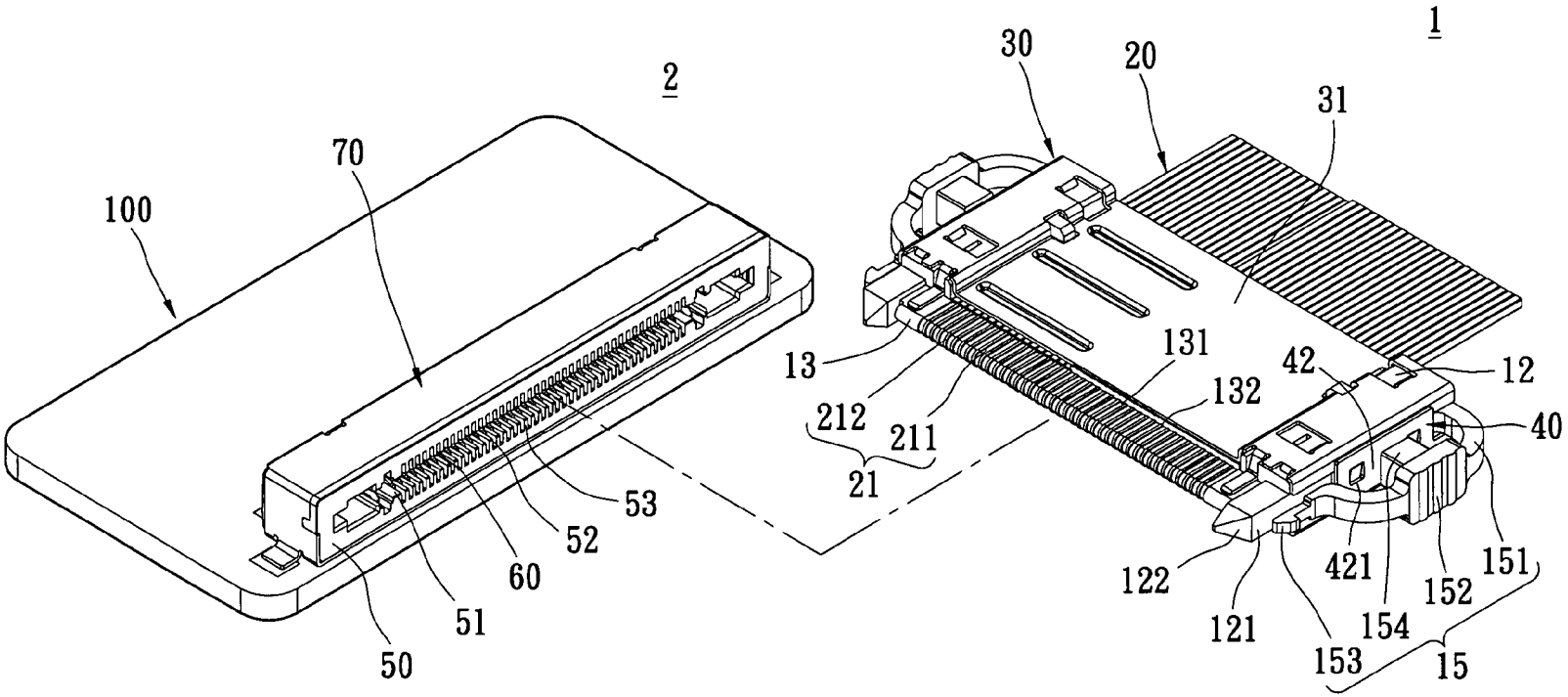
FIG. 4 is an assembling perspective view of the electrical connector of the present invention and the jointed connector.
Figure 5A:
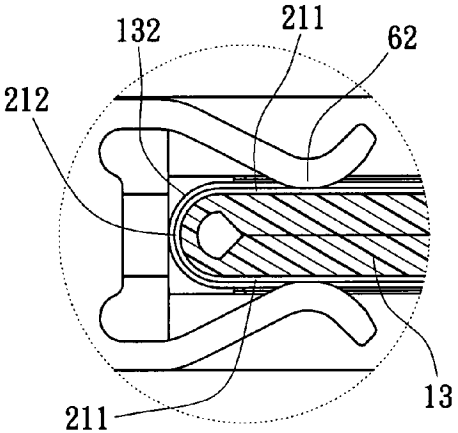
FIG. 5A is an amplified diagram of the part A in FIG. 5.
Figure 5:
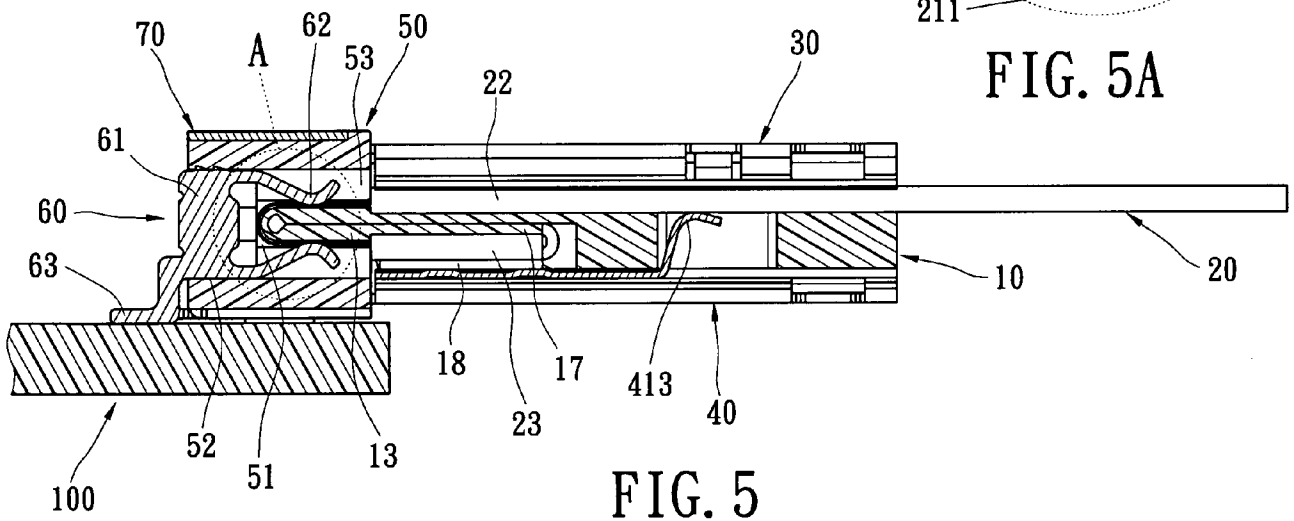
FIG. 5 is a cross-sectional view of the electrical connector of the present invention plugged with the jointed connector.

Reference is made to FIGS. 4 and 5. The electrical connector 1 is used for plugging with a jointed connector 2. The jointed connector 2 can be located on a circuit board 100. By plugging the electrical connector 1 with the jointed connector 2, the signal is transmitted between the circuit board 100 and the flexible bus line 20.

The jointed connector 2 includes an insulating main body 50, a plurality of pins 60, and a sheltering housing 70. The front end of the insulating main body 50 indents inwards to form a receiving slot 51 that corresponds to the jointing portion 13 of the electrical connector 1. The upper inner wall and the lower inner wall of the receiving slot 51 indent to form a plurality of pin-slots 52 for receiving the pins 60. A plurality of blocking walls 53 are formed between the pin-slots 52 that correspond to the separating boards 132 of the electrical connector 1.

Each pin 60 includes a base portion 61, two contacting portions 62, and a welding portion 63 (referring to FIG. 5). The base portion 61 is received in the pin-slots 52. The front end of the base portion 61 extends to form the two contacting portions 62, and the two contacting portions 62 are located at the upper location and the lower location. The contacting portions 62 extend into the receiving slot 51 for electrically connecting the contacting portions 211 of the electrical connector 1. The welding portion 63 extends to outside of the insulating main body 50 and is welded onto the circuit board 100, and is electrically connected with the circuit board 100.

The sheltering housing 70 is made of metal material, and is covered on the insulating main body 50 for sheltering the EMI.

When the electrical connector 1 of the present invention is plugged with the jointed connector 2, the electrical connector 1 is guided by the two guiding portions 121 to exactly be plugged into the jointed connector 2.

The electrical connector 1 uses the contacting portion 211 of the flexible bun line 20 to contact the contacting portion 62 of the pin 60 of the jointed connector (referring to FIG. 5A). Thereby, electrical connection is achieved. The two contacting portions 62 of the pin 60 are located in a lower location and an upper location so that the contacting portions 211 located at two sides of the jointing portion 131 are uniformly exerted a force. The location of the metal conducting line 21 is restricted by the slot 131 so that the metal conducting line 21 can exactly be jointed with the pin 60. The problem of the metal conducting line 21 being jointed with the pin 60 at a wrong location is avoided.

Furthermore, because the separating board 132 is contacted with the blocking wall 53, the slot 131 and the pin-slot 52 form an enclosed space. Therefore, even though the metal conducting line 21 has the metal beard, the metal beard still cannot stride across to the adjacent metal conducting line 21. Thereby, the problem of short circuit generated when the electrical connector 1 is plugged with the jointed connector 2, or the circuit board 100 being burn down is avoided.

Because the locking portion 153 of the wedging part 15 is wedged and locked in the wedging hole (not shown in the figure) of the sheltering housing 70 located at the interior of the insulating main body 50, the electrical connector 1 is firmly connected with the jointed connector 2. When the user wishes to separate the electrical connector 1 and the jointed connector 2, the user only needs to presses the pressing portion 152 of the wedging part 15 to make the locking portion 153 be separated from the locking hole.

Figure 6:
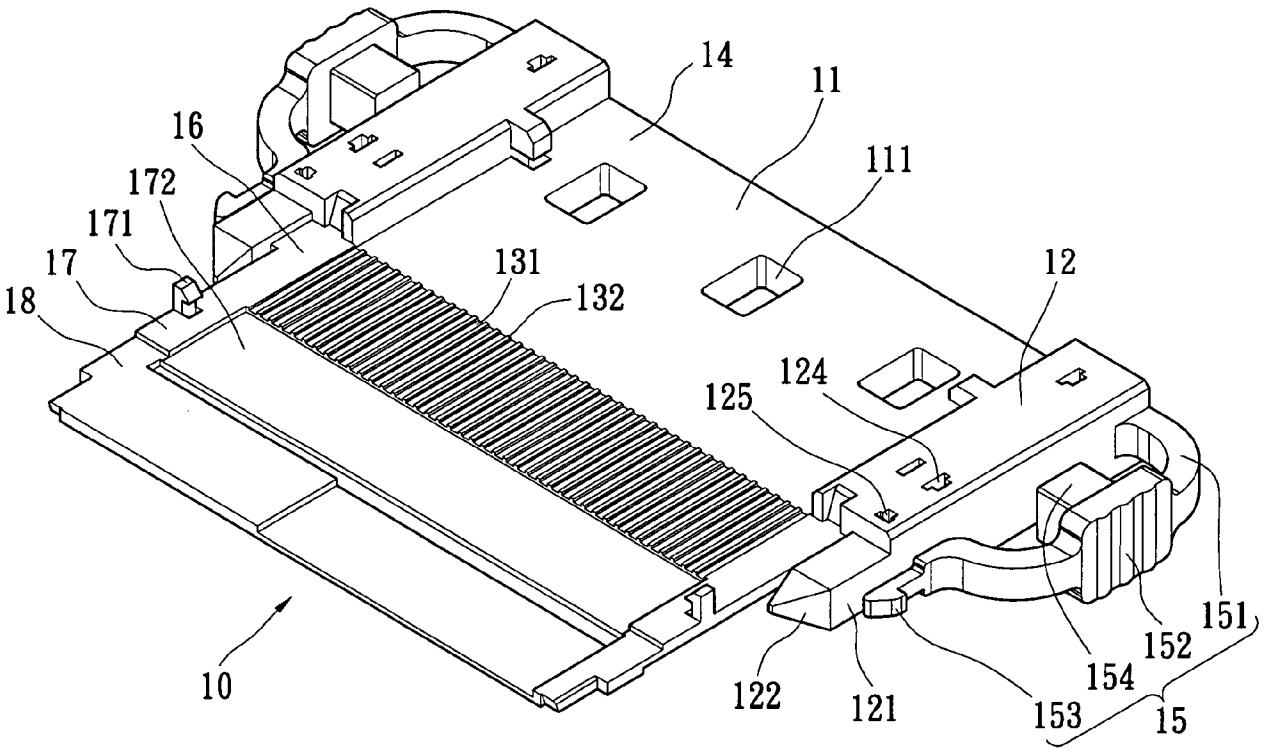
FIG. 6 is a perspective view of the insulating main body of the present invention being unfolded.
Figure 7:
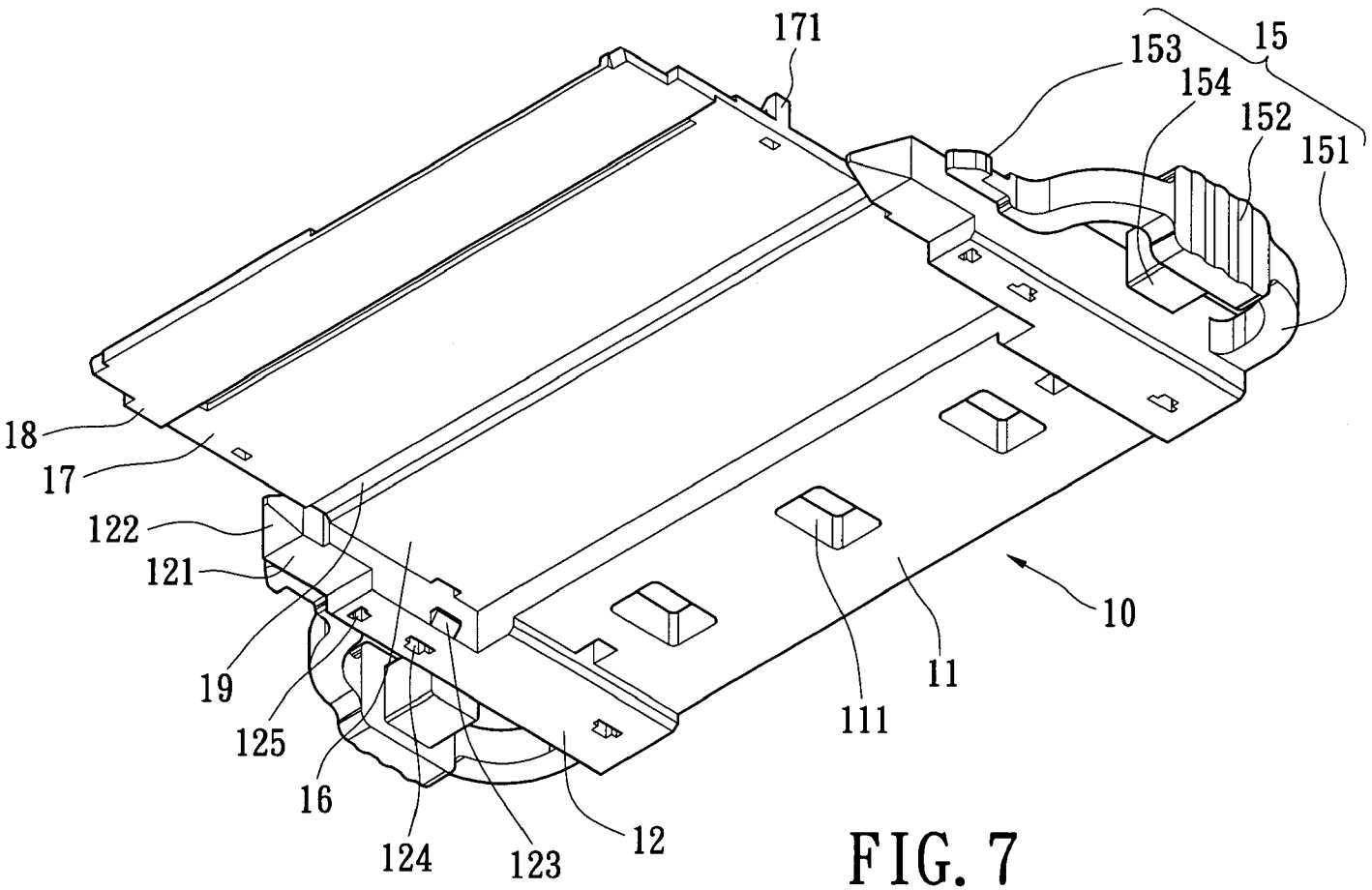
FIG. 7 is another perspective view of the insulating main body of the present invention being unfolded.

Reference is made to FIGS. 6 and 7. Before the insulating main body 10 is assembled, the insulating main body 10 has an unfolded shape, and includes a first portion 16, a second portion 17, and a third portion 18. The first portion 16 extends forwards from the base portion 11. At the bottom surface of the first portion 16, there is a horizontal concave slot 19 so that the first portion 16 is easily bent backwards. The slots 131 are located at the top surface of the first portion 16. The second portion 17 extends forwards from the first portion 16. At two sides of the second portion 17, each has wedging portion 171. At the front center of the second portion 17, there is a concave portion 172 for receiving the second area 23 of the flexible bus line 20. The third portion 18 extends forwards from the second portion 17. The thickness of the third portion 18 is thinner than the thickness of the second portion 17. The third portion 18 has an area that corresponds to the flexible bus line 20 to match the second area 23 of the flexible bus line 20.

Figure 8:
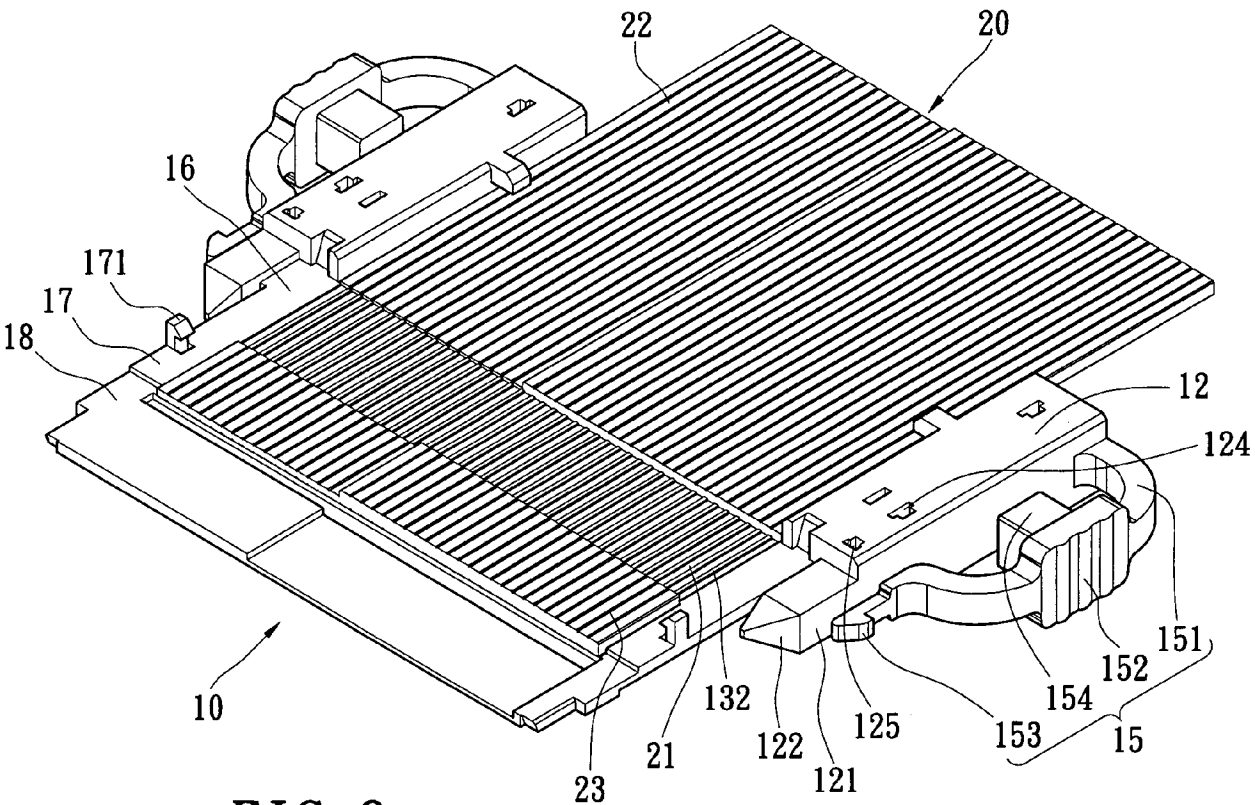
FIG. 8 is a perspective view of the insulating main body of the present invention being installed with the flexible bus line.

Reference is made to FIG. 8. When the electrical connector is assembled, the flexible bus line 20 is unfolded, and the first area 22 and the second area 23 are respectively received in the receiving space 14 and the concave portion 172 of the second portion 17 (referring to FIG. 6). Next, the metal conducting line 21 is located in the slot 131 so that metal conducting line 21 is separated from each other by the separating boards 132. Therefore, the problem of short circuit generated between the adjacent metal conducting lines 21 due to the metal conducting line (such as tin-plated line) has the metal beard (such as tin beard) is avoided.

Figure 9:
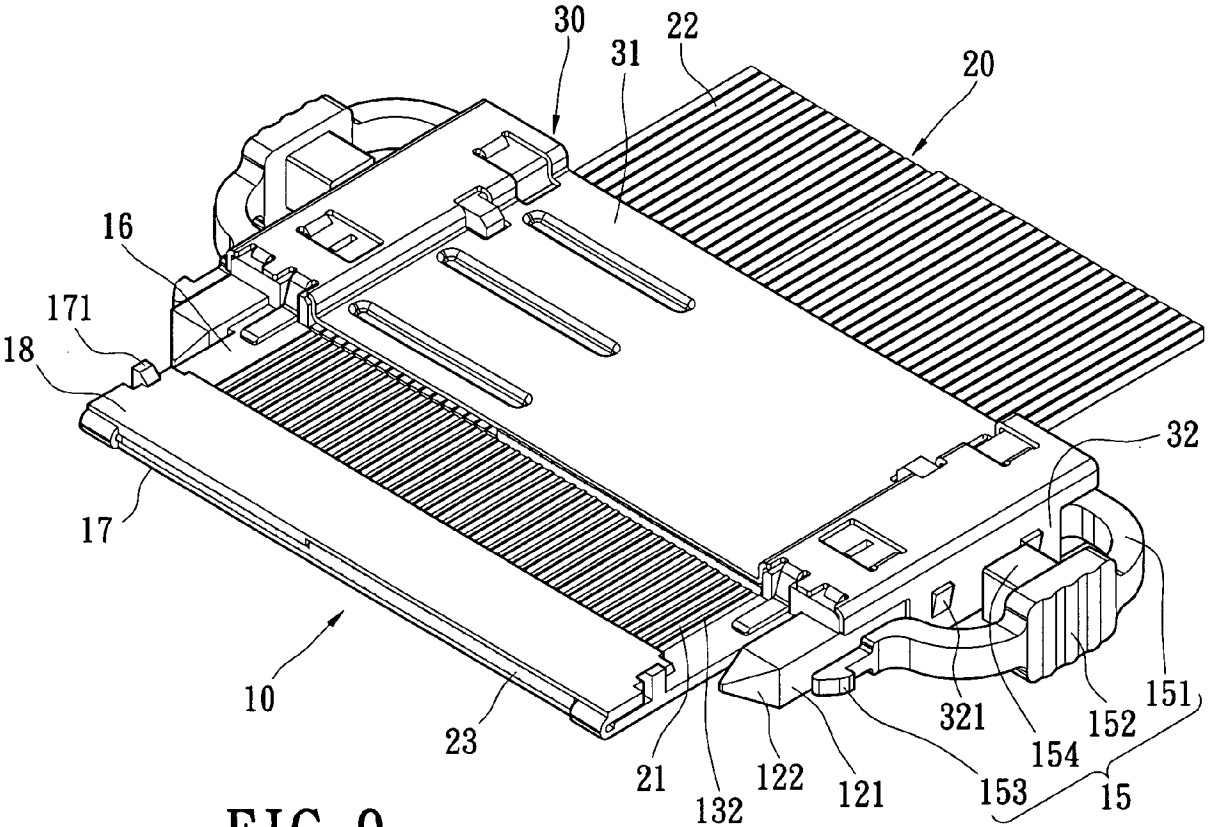
FIG. 9 is a perspective view of the third portion of the insulating main body of the present invention being bent backwards.

Reference is made to FIG. 9. The third portion 18 of the insulating main body 10 extends upwards and then extends backwards to face to the top surface of the second portion 17 and be bent backwards. The two sides of the third portion 18 are wedged with the two wedging portions 171 of the second portion 17. Therefore, the second area 23 of the flexible bus line 20 is clipped between the second portion 17 and the third portion 18. Next, the first metal shell 30 is combined with the insulating main body 10 so that the first area 22 of the flexible bus line 20 is compressed between the first metal shell 30 and the insulating main body 10. Thereby, the first area 22 and the second area 23 of the flexible bus line 20 are fastened.

Figure 10:
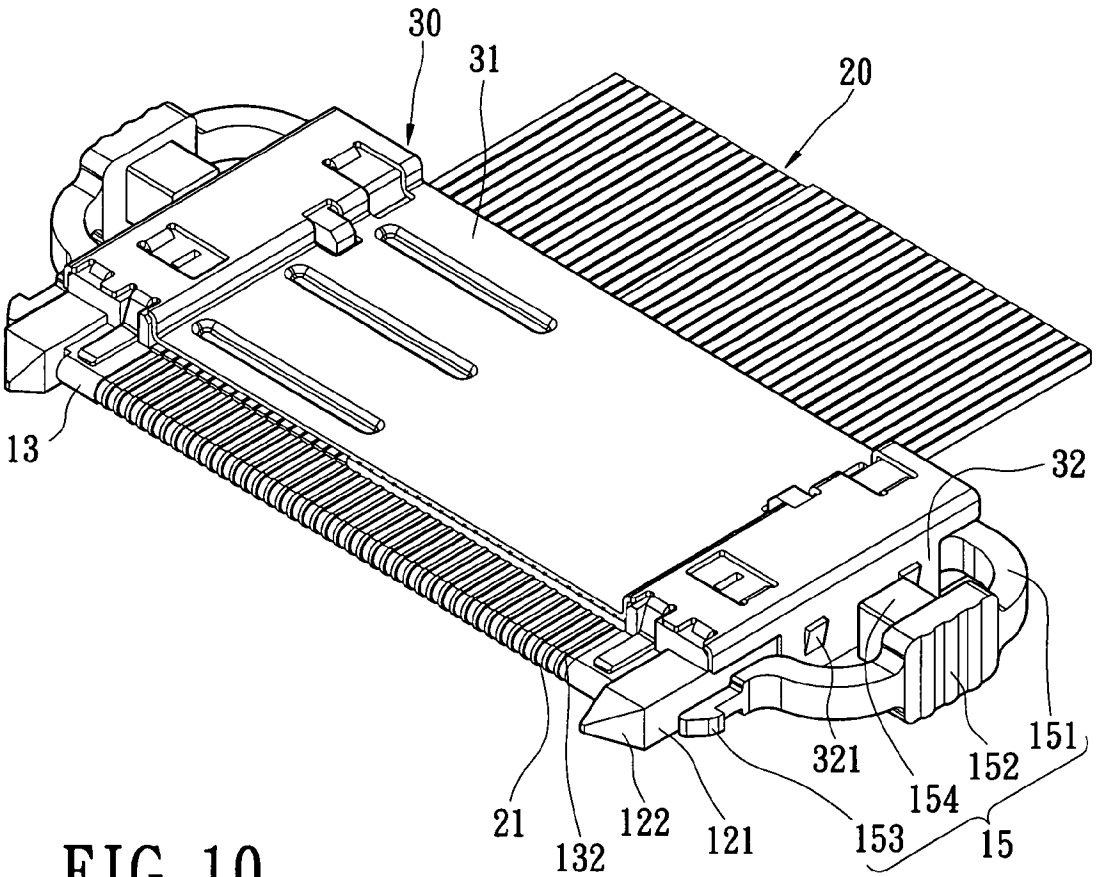
FIG. 10 is a perspective view of the first portion of the insulating main body of the present invention being bent backwards.
Figure 11:
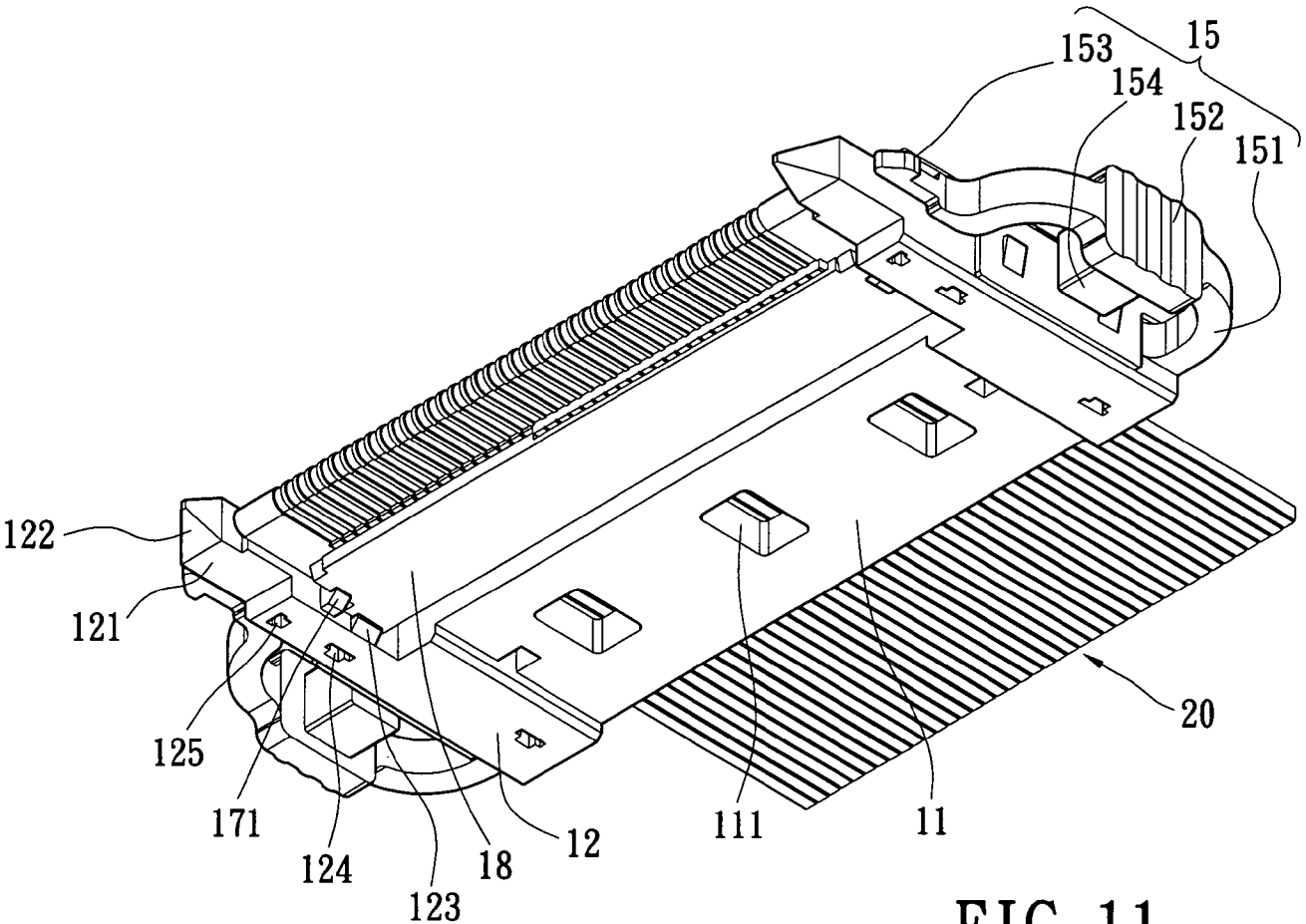
FIG. 11 is another perspective view of the first portion of the insulating main body of the present invention being bent backwards.

Reference is made to FIGS. 10 and 11. The first portion 16 is bent downwards and backwards to face to the bottom surface of the base portion 11 to form the jointing portion 13 so that the second portion 17 and the third portion 18 are located below the base 11 of the insulating main body 10 (referring to FIG. 3) and the two sides of the third portion 18 are wedged with the two wedging bodies 123. Next, the flexible bus line 20 is bent backwards to make the contacting portions 211 of the metal conducting line 21 respectively be located at the upper side and the lower side of the jointing portion 13.

Figure 12:
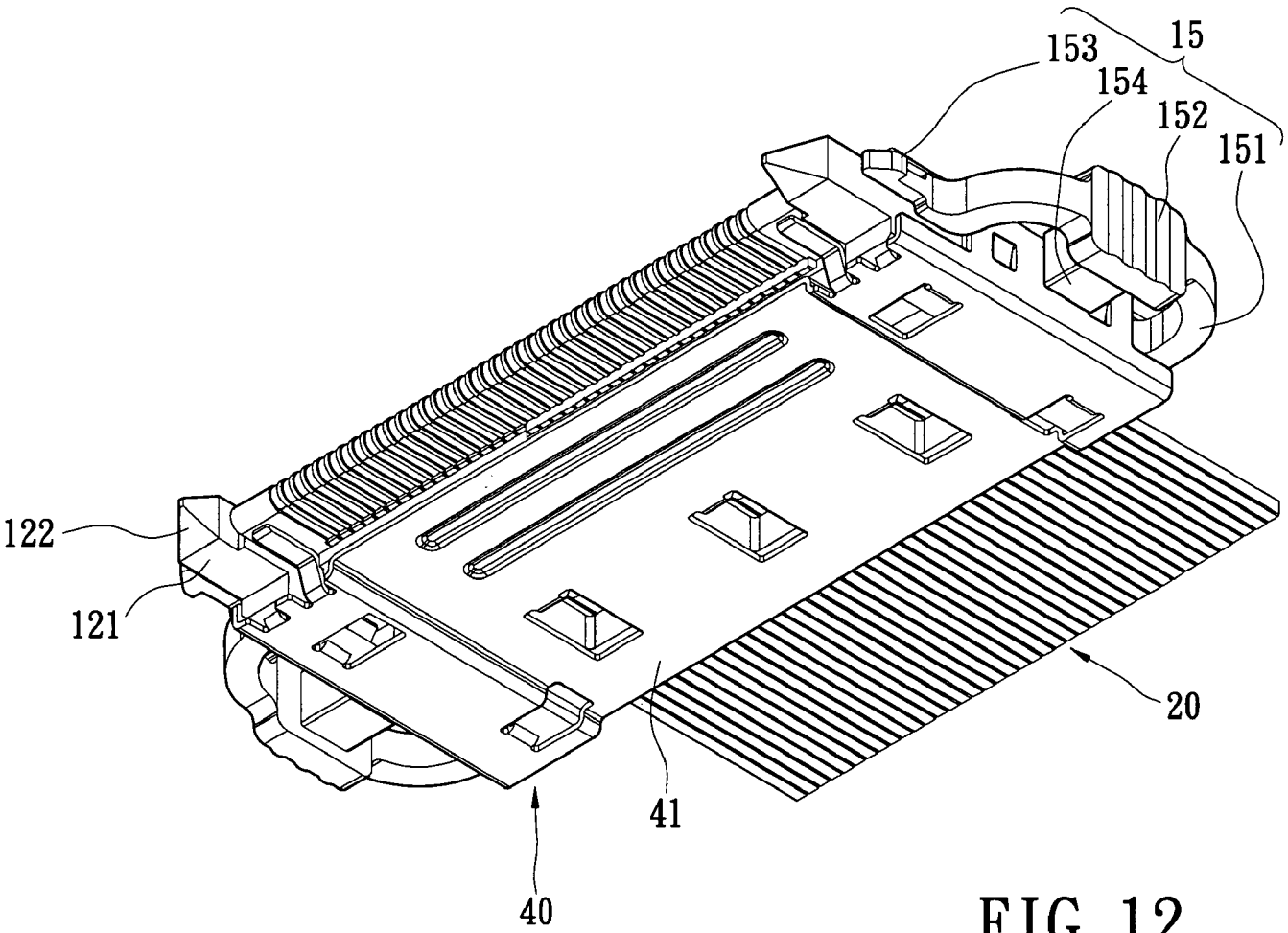
FIG. 12 is a perspective view of the insulating main body of the present invention being installed with a second metal shell.

Reference is made to FIG. 12. Finally, the above structure is installed at the bottom of the insulating main body 20 and is wedged with the first metal shell 30. The electrical connector 1 is finished.

The present invention has the following characteristics:

1. The present invention uses the metal conducting line 21 of the flexible bus line 20 to replace the pin of the electrical connector of the prior art. The required components are reduced. The welding procedure is not required again, and the manufacturing process is simplified.

2. It does not need to manufacture the pin. The manufacturing cost is reduced.

3. The flexible bus line 20 can be easily manufactured. By utilizing the characteristic of the insulating main body 10 being folded, the flexible bus line 20 can be easily combined with the insulating main body 10 and the metal conducting lines 21 are located at the two sides of the jointing portion 13. The assembling time is reduced, and the yield rate is increased.

4. The metal conducting lines 21 are respectively located in the slots 131 so that the metal conducting lines 21 can be respectively and exactly positioned to the jointing portion 13, and the pitch between two metal conducting lines 21 is maintained.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electrical connector, comprising:

an insulating main body having a base portion and two side portions, wherein the two side portions are located at two opposite sides of the base portion, a front edge of the base portion has a jointing portion, and the jointing portion has a plurality of slots;

a metal shell covered on the insulating main body; and a flexible bus line clipped between the insulating main body and the metal shell, wherein there are a plurality of naked metal conducting lines at a middle of the flexible bus line, the metal conducting lines are located in the corresponding slots of the jointing portion, each of two ends of each of the metal conducting lines forms a contacting portion, and the flexible bus line is bent backwards so that the two contacting portions are respectively located at the two opposite sides of the jointing portion.

2. The electrical connector as claimed in claim 1, wherein there are a plurality of separating boards between the slots.

3. The electrical connector as claimed in claim 1, wherein the slot extends from a top surface of the jointing portion, passes through a front edge of the jointing portion, and extends to a bottom surface of the jointing portion.

4. The electrical connector as claimed in claim 1, wherein each of the front ends of the two side portions has a guiding portion, and a front end of the guiding portion has a guiding slanted surface.

5. The electrical connector as claimed in claim 1, wherein each of the side portion has a wedging part, the wedging part has a pressing portion and a locking portion, and the locking portion extends from one end of the pressing portion.

6. The electrical connector as claimed in claim 1, wherein the flexible bus line includes a first area and a second area, the first area and the second area are respectively connected with two ends of the metal conducting lines, the flexible bus line is bent backwards so that the first area and the second area are parallel to each other and are respectively located at the upper side and the lower side of the base portion of the insulating main body, and the first area is clipped between the base portion of the insulating main body and the metal shell.

7. The electrical connector as claimed in claim 6, wherein the insulating main body comprises a first portion extended from the base portion, a second portion extended from the first portion and a third portion extended from the second portion, the slots are located at a surface of the first portion, the first portion is bent backwards to face forward a bottom surface of the base portion so that the second portion and the third portion are located below the base portion, two wedging portions respectively are located at two sides of the second portion, and the third portion is bent backwards to face to the second portion and is wedged with the two wedging portions so that the second area is clipped between the second portion and the third portion.

8. The electrical connector as claimed in claim 7, wherein there is a wedging body at each of two side portions that are closed to the inner side of the bottom of the two side portions, the two sides of the third portion is wedged with the two wedging bodies when the first portion is bent backwards to face to the bottom surface of the base portion.

9. The electrical connector as claimed in claim 1, wherein the flexible bus line is covered with a sheltering layer for sheltering EMI.

10. The electrical connector as claimed in claim 1, further comprising a second metal shell, the second metal shell is located below the insulating main body, and is connected with the metal shell.

* * * * *